US005885033A

United States Patent [19]

Krings

[11] Patent Number: 5,885,033

[45] Date of Patent: Mar. 23, 1999

[54] HOUSING FOR A SUPPORT SHOE IN A TRENCH FALSEWORK

[75] Inventor: Josef Krings, Heinsberg, Germany

[73] Assignee: Wolfgang Richter, Hurtgenwald, Germany

[21] Appl. No.: 793,893

[22] PCT Filed: Aug. 4, 1995

[86] PCT No.: PCT/DE95/01039

§ 371 Date: May 7, 1997

§ 102(e) Date: May 7, 1997

[87] PCT Pub. No.: WO96/08607

PCT Pub. Date: Mar. 21, 1996

[30] Foreign Application Priority Data

Sep. 12, 1994 [DE] Germany ..... 44 32 319.0

[51] Int. Cl.[6] ..... E02D 17/08

[52] U.S. Cl. ..... 405/282; 405/272; 405/273

[58] Field of Search ..... 405/282, 283, 405/272, 273, 258

[56] References Cited

U.S. PATENT DOCUMENTS 3,347,049 10/1967 Keine .
3,593,528 7/1971 Pavese .
4,056,938 11/1977 Griswold .
4,139,324 2/1979 Krings ..... 405/282
5,052,862 10/1991 Uffmann ..... 405/282

FOREIGN PATENT DOCUMENTS 26 24 954 A1 12/1977 Germany .
42 09 675 C1 7/1993 Germany .

*Primary Examiner*—Dennis L. Taylor
*Attorney, Agent, or Firm*—Kennedy Covington Lobdell & Hickman, LLP

[57] ABSTRACT

The invention concerns a housing (18), in a trench falsework panel, designed to hold the support shoe for a strut (17) so that the strut is secured in place at a spring joint. The housing permits the support shoe, which is directly associated with the strut, to be mounted simply in place by virtue of the fact that the longitudinal ends of the housing have a collar (21) projecting out from the surface of the panel, at a certain distance from the strut, with a bore running at right angles to the longitudinal axis of the housing, and the support shoe has a collar, matching that on the housing, with a bore, aligned with that in the housing collar, into which a bolt (25) can be inserted to hold the shoe in place.

23 Claims, 2 Drawing Sheets

HOUSING FOR A SUPPORT SHOE IN A TRENCH FALSEWORK

Figure 2:
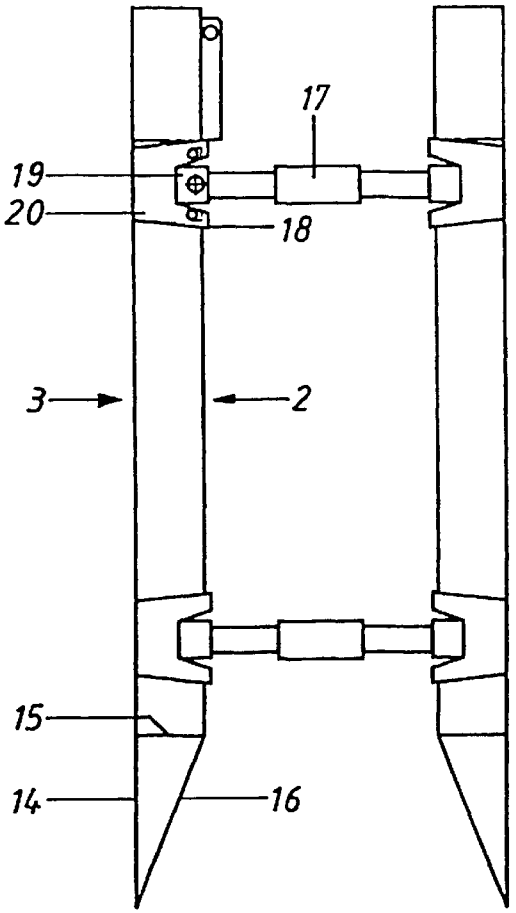

The invention relates to the housing in a trench lining plate for receiving the support shoe for a brace, which is intended to be resiliently fastened, of a pair of lining plates of a trench lining device (lining box), which are intended to be maintained at a distance by means of the brace, wherein the brace preferably is intended to be fastened in a receptacle of the support shoe with the aid of a brace holding bolt which is intended to be pushed through bores aligned transversely in respect to the longitudinal direction of the housing.

A support shoe housing of this type can be derived from DE 42 09 675 C1. The known housing, which there is embodied as a box-shaped pocket of the support shoe, does not project past the exterior surface of the lining plate which is to face the interior of the trench. Bolts or screws, which are situated inside the lining plate parallel with its exterior surfaces, are therefore required for fastening the support shoe and lastly the brace in the lining plate. For this reason recesses of the sheet metal cover plates of the lining plate are therefore required at at least two locations outside of the support shoe for the access to the "inner" bolts or screws. The combination of two tasks, namely fixing the support shoe in place and the pivotability in a bolt, however merely has the result that this bolt can only be mounted or removed through an opening in the body of the lining plate, for example a recess of a cover surface.

As the means for resiliently hinged fastening of the brace with the aid of the support shoe in a trench lining plate, it is proposed in the not previously published German Patent Application P 43 41 626.8 to seat the brace receivers respectively on a pair of helical pressure springs which are positioned next to each other on both sides of the brace holding bolt. Fastening of the support shoe in the lining plate takes place with the aid of a bolt which simultaneously constitutes the pivot shaft of the support shoe.

It is a first object of the invention to create a support housing arrangement which permits the creation of a support shoe with the resiliently hinged fastening, in particular in accordance with P 43 41 626.8 which, when the arrangement of the hinge and spring elements is seated within the body of the respective lining plate, permits the fastening of the support shoe as well as of the brace within the body of the plate.

The attainment in accordance with the invention of the first object consists in that the housing of the type mentioned at the outset has housing collars, which project at a radial distance on both sides of the brace holding bolt past the adjoining exterior surface of the lining plate intended to be facing the inside of the trench, and have at least one continuous housing bore, and that the support shoe has shoe collars corresponding to the housing collars and essentially extending parallel therewith after assembly, with respectively one continuous shoe bore aligned with a housing bore for inserting a shoe holding bolt.

A characteristic preferred by the invention consists in that the two collars or collar layers (with the support shoe housing extending longitudinally in the transverse direction in respect to the brace holding bolt) are only provided in the area in front of and up to the ends of the longitudinal sides of the housing—and, if required, transversely in respect to it at the longitudinal ends—, because in the center area the collars would hamper the assembly or disassembly of the brace holding bolt. In other words it can be stated that the support shoe housing and the support shoe each have a collar extending past the exterior surface, which has recesses in the center area of the longitudinal sides of the housing at the places where the brace holding bolt must be pulled or pushed during assembly or disassembly. The two collars (of the support shoe and the housing) project two-dimensionally vertically (or obliquely) close to each other from the exterior surface, so that they are intended to be coupled by the shoe holding bolts like two collar layers along two straight lines.

The two or more shoe holding bolts positioned in accordance with the invention for fastening the support shoe in the support shoe housing are both located outside of the body of the lining plate over the adjoining exterior surface. They are arranged in such a way that after insertion of the support shoe into the support shoe housing they can be set and secured with a few manipulations. Assembly and disassembly of the shoe holding bolts can take place in the same way as that of the brace holding bolts. Preferably the three bolts of each brace holder are essentially disposed in one plane above the exterior surface of the lining plate. Thus, assembly and removing is made easier by the invention, without the brace holder projecting from the surface which faces the inside of the trench more than with known holders, because the shoe holding bolts and their seating (i.e. the drilled collar layers connected by bolts) do not project further toward the inside of the trench than the brace receivers with the associated shoe holding bolts.

In accordance with the invention it can further be advantageous to design the longitudinal ends of the walls of the support shoe housings not vertically, but obliquely in respect to the adjoining exterior surface of the lining place such, that the housing in its entirety is represented to be conically opening toward the exterior. By means of this it is achieved on the one hand, that dirt can fall out or can easily be rinsed out with water and, on the other hand, assembly of the support shoe, which is preferably approximately cube-shaped in its exterior—except for the collar recess—, in the housing is made easier. In order to prevent water from collecting in the support shoe housing, for example if the lining plate is stored outside, a bore through which water can run out is advantageously provided in the bottom of the housing, i.e. in the cover surface located opposite the receiving side.

If in an installed lining box the excavator is worked forward in the trench, it can reach with its bucket underneath the braces which closest adjoin the advance. In the process the bucket of the excavator rapidly reaches the area at the trench point ahead of the advancing end of the lining box. It is often not possible to prevent the settling of the dirt from the sides of the trench in this unlined area. Then cracks often occur in the streets or houses.

Accordingly, it is a further object of the invention to create a lining box and with it a lining plate which allows the matching of the advance end of the supported areas of the trench and the maximum advance which can be achieved by means of the excavator to each other in such a way that no dirt can settle from the sides of the trench when the excavator bucket has respectively reached the working end. The attainment in accordance with the invention of this further object lies in that the support shoe housing is approximately arranged ahead of the advancing end of the lining box in the direction toward the plate surface by the amount of the distance over which an excavator bucket during digging can reach underneath the brace which adjoins the advancing end.

By means of this a support shoe arrangement of the lining plate is created wherein the support shoes or other resiliently linked fastenings of the braces are not fastened directly on the plate edge—this applies in particular in the case wherein two pairs of braces located above each other are provided in the vicinity of the plates edges—but further in the direction toward the plate center. The excavator, which must reach below the lower brace with its bucket, wherein the radius of action of the excavator boom is limited by the brace, then cannot reach the unlined area into which dirt could settle from the sides of the trench. By means of the displacement in accordance with the invention of the brace fastening more toward the center of the plates, settling of the dirt and thus the formation of cracks in the road or in adjoining houses can be prevented in the simplest way.

In accordance with a realization of the inventor, a lining plate of the type described becomes particularly rigid if it has a circumferential hollow profile frame. The hollow profile can have a rectangular cross section at the top edge and the lateral edges, a triangular profile is mostly provided at the underside, if the plate is intended to have a cutting edge there for being driven forward through the ground. In accordance with a third attainment in accordance with the invention of the object, the support shoe housings are not installed in, but next to the hollow profiles on the lining plate in order not to weaken the stability provided by means of the circumferential hollow profile frame. Each housing can be directly attached, in particular welded, to the hollow profile, for example in a recess of the plate body, however, it is also possible to provide intermediate elements between the exterior surface of the housing and the "inner" surface of the hollow profile facing the plate body.

However, as solid as possible a connection, in particular by direct contact between the materials, between the inner surface of the hollow profile and the support shoe housing is advantageous, so that forces exerted on the support shoe housing during its use cannot lead to a deflection of the housing relative to the surface of the lining plate. For this reason it can be advantageous to attach the support shoe housing in a corner of the frame, for example in the corner between the hollow profile of the upper edge and that of the lateral edge, and respectively on the inside of the frame.

In accordance with a preferred further embodiment of each one of the above attainments in accordance with the invention of the objects, an additional rigidity results if brackets attached, in particular welded, to the support shoe housing and extending laterally over the adjoining hollow profile of the frame and welded to it, are provided for absorbing torsion moments possibly exerted on a support shoe housing. Such brackets can extend in the longitudinal direction as well as the transverse direction of the support shoe housing over the respectively adjoining hollow profile. Preferably the brackets or sheet metal plates provided vertically or obliquely in respect to the exterior plate surface at the longitudinal ends of the support shoe housing extend over the adjoining hollow profile. Alternatively it is possible for the longitudinal sides of the support shoe housing to project past its longitudinal end and to be welded to the adjoining hollow profile. In this case it is within the scope of the invention to provide one or several brackets on each of the sides or end faces of the support shoe housing and to weld them together with the adjoining hollow profile.

Under actual working conditions there is often the desire to connect plates standing next to each other in the trench in such a way with each other that the braces in the connection area can be partially or totally removed and more space is made for excavating work or the insertion of long pipes. In accordance with a further development of the invention, the brackets projecting away from the support shoe housings and welded to the hollow profiles are used as connecting points for fastening lining plates standing next to each other in the trench. For this purpose the brackets are provided with bores, for example, which are intended to be connected via connecting elements with the respective bore or bracket of the adjoining plate. The connecting elements should be releasably connected with the brackets and should be long enough that they prevent the interfering movement of the plates against each other in the connecting area. In further accordance with the invention the brackets can be used in a similar manner for connecting built-up or raised elements, i.e. of additional plates to be placed on top of existing plates. Basically the raised elements can be embodied similar to the described lining plates. However, the cutting edge provided on the lower edge of the base plates is not necessary.

In accordance with the invention it is preferably intended, different from DE 41 11 266 C1, for example, to avoid stabilizing the support shoe housing of the support shoe in the hollow profile frame of the lining plate, because the rigidity of the frame itself is impaired by this. Furthermore, in accordance with the invention the design in accordance with P 43 41 626.8, wherein the hinge bolt of the support shoe is simultaneously employed for fixing the support shoe in place in the lining plate, is further developed; in place of the one bolt, three bolts are provided in the design in accordance with the invention. The hinged bolt remains unchanged here, but it is integrated in the per se transportable preassembled support shoe itself. The two other bolts, which in accordance with the invention are added, are mounted with the aid of the collars and their bores outside of the plate body. Therefore the assembly or disassembly of a support shoe does not require weakening of the lining plate or even the hollow profile frame. The tasks assumed by one hinged bolt in accordance with P 43 41 626.8 are distributed to two bolt types! Furthermore, the stabilizing effect of the hollow profile by lateral welding of the housing and, if desired, by the brackets welded on top is employed without hampering the stabilizing effect of the hollow profile on the entire plate. With the design in accordance with the invention, the lining plate has no recesses or built-ins which impair the moment of resistance of the plate.

When used in the trench, a lining plate is lifted for further placement and again driven into the ground and/or pulled along in the longitudinal direction of the trench. In both cases the crane or the like requires attachment points on the plate. In accordance with a further development of the invention the brackets attached to the support shoe housings and welded together with the adjoining hollow profiles are connected in pairs with each other to one or several housings by bolts or other rods, which can be welded or screwed to the brackets. The eyes created in this way represent ideal attachment points for a crane hook, a cable or the like.

Figure 1:
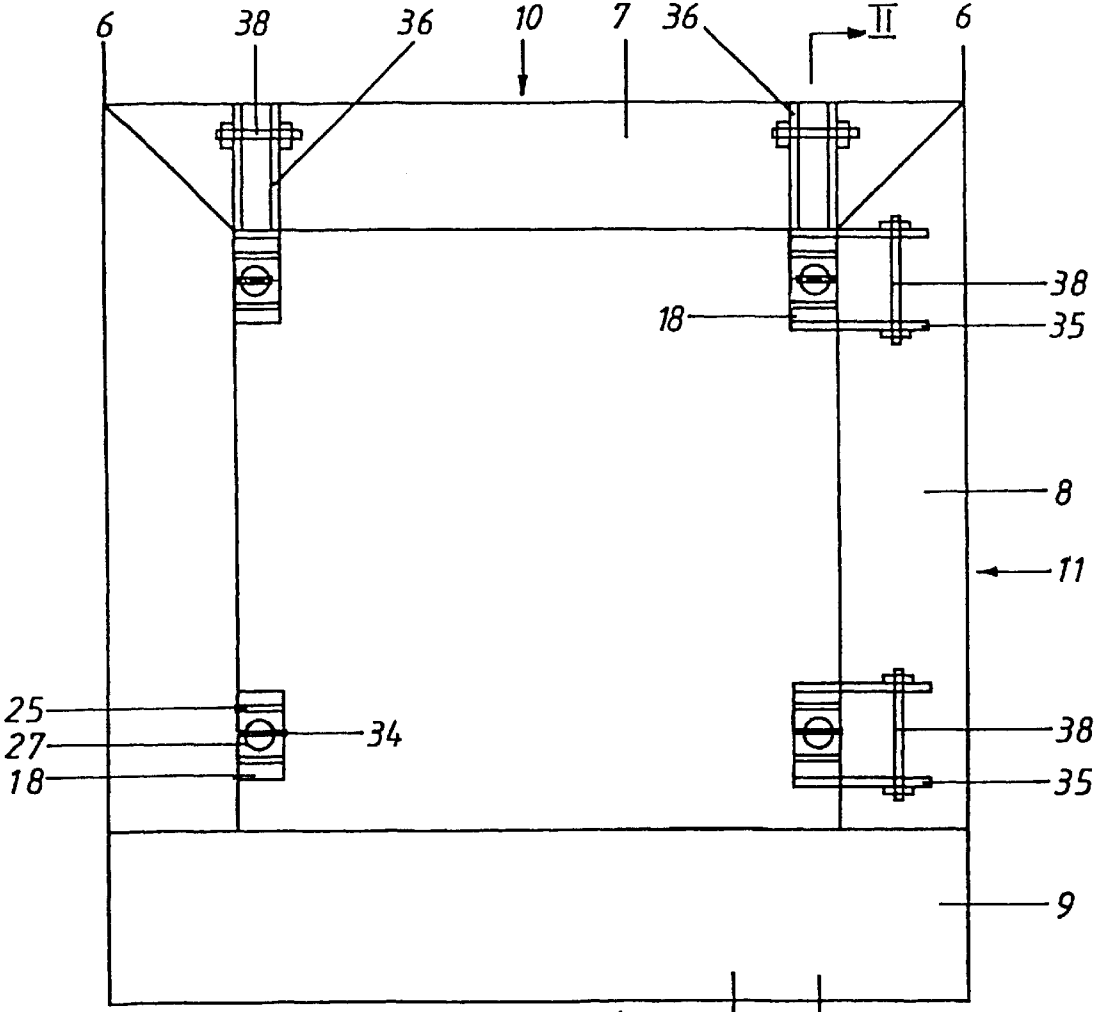
Figure 3:
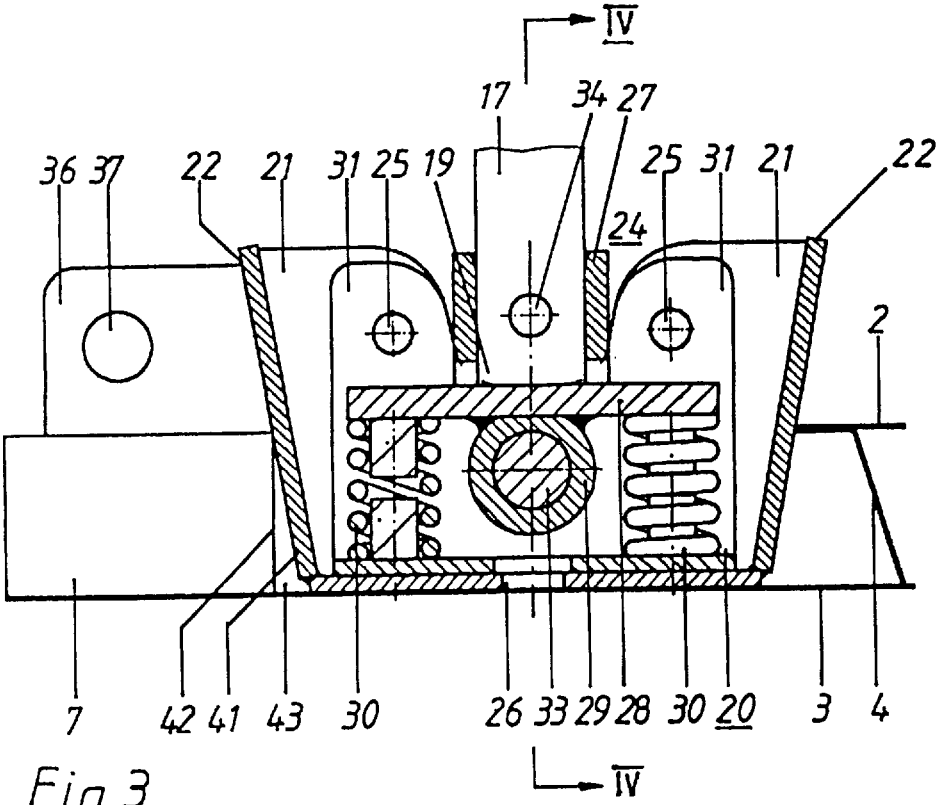
Figure 4:
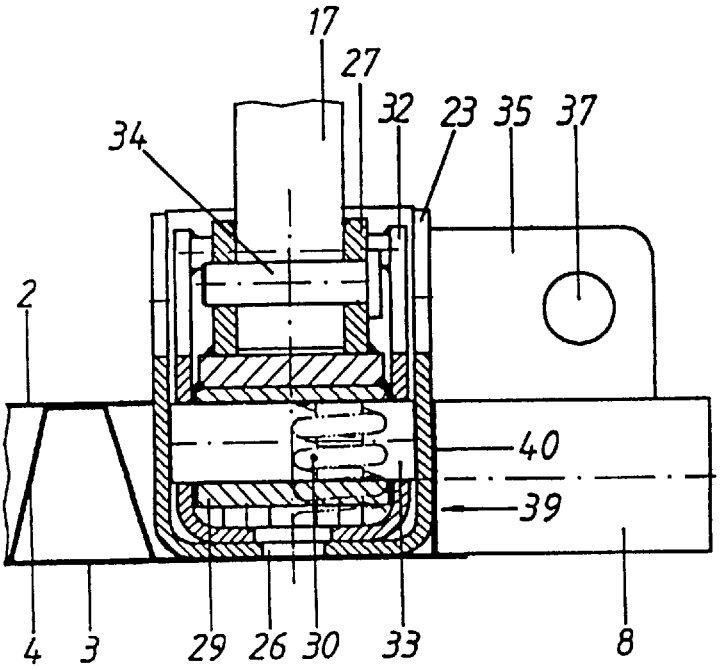

Details of the invention are explained by means of the schematic representation of exemplary embodiments. Shown are in:

FIG. 1, a view of the inside (side facing inside the trench) of a lining plate;

FIG. 2, a lining box of two lining plates in FIG. 1, approximately along the section II—II in FIG. 1;

FIG. 3, an enlarged representation of the section through a shoe support housing with support shoe in FIG. 2; and FIG. 4, a section along the line IV—IV in FIG. 3.

The lining plate represented in FIGS. 1 and 2, identified as a whole by 1, consists of two rectangular sheet metal covers 2 and 3 with profiled sheet metal elements 4 enclosed between them and a circumferential hollow profile frame 5 welded to the cover surfaces 2 and 3, which consists of respectively one hollow profile 7, 8 and 9 uninterruptedly extending from the frame corner 6 to the frame corner 6. The ends of the hollow profiles 7 to 9 meeting at the frame corners 6 are welded together in such a way that the rectangular frame construction becomes one piece, so to speak. The hollow profiles 7 to 9 can be longitudinally welded or seamlessly welded or drawn. Preferably these are not only U- or C-profiles, but hollow profiles closed in a tube-like manner.

In detail the frame structure 5 represented consists of a pressure cross beam 7 particularly stabilized against flexural buckling at the upper plate edge 10, of respectively one vertical cross beam 8 stabilized against forces in the vertical longitudinal direction at the plate sides 11, and a pointed hollow profile 9 having a cutting edge 12 on the lower plate edge 13. While the pressure cross beam 7 and the vertical cross beam 8 are intended to have a rectangular cross section, the pointed hollow profile 9 has an approximately cross section on the lower edge 13 in the form of a right triangle, whose one cathetus 14 lies in the plane of the rear wall 3, whose other cathetus 15 lies vertically in respect to the plane of the cover surface 2, 3 and whose hypotenuse 16 is intended to face the interior of the trench.

Support shoe housings 18 provided for placing and fastening the braces 17 in place are inserted with the opening into the lining plate at the sheet metal cover 2, which is on the inside during lining, and preferably directly adjoining the hollow profiles 7 to 9, without there being a need for any weakening, in particular recesses, in the hollow profiles 7 to 9. If for any reason the hollow profiles 7 to 9 are not provided, it can still be advantageous to arrange the support housing shoes 18 in the plate surface at a suitable distance from the vertical plate edges 11. In this case the distance should preferably be sufficiently great so that an excavator bucket can reach underneath the brace at the advance end without dirt settling from the sides of the trench. Each support shoe housing 18 receives a support shoe 20 which is intended to be connected with an end 19 of a brace 17. The details in connection with this will be represented more clearly in FIGS. 3 and 4.

In accordance with the invention the support shoe housing 18 has collars 21 on its longitudinal ends, which project beyond the inner sheet metal cover 2 (oriented toward the interior of the trench if required). In the center of the length of the housing, i.e. in the center between the longitudinal ends 22 of the housing 18, its lateral walls 23 only extend to the level of the inner sheet metal cover 2, so that a recess 24 of the collar 21 appears there. In the area of the collar 21 the lateral walls 23 have continuous, aligned bores on both sides of the recess 24 for inserting a bolt, the so-called shoe holding bolt 25.

The surfaces of the support shoe housing 18 at its longitudinal ends 22 can be embodied to be vertical in respect to the sheet metal covers 2, 3, however, in the way represented, also oblique or conically opened toward the interior of the trench. The oblique shape of the end faces of the longitudinal ends 22 makes cleaning the housing 18 simpler. A drain hole 26 can be provided in the bottom of the housing 18, penetrating the sheet metal cover 3 there, which prevents the accumulation of water in a horizontally lying plate.

A support shoe 20 is received in the support shoe housing 18. Part of the support shoe 20 are a receptacle 27 for inserting the brace 17; a support plate 28 which rests vertically under the receptacle 27 on a bearing 29 and is welded together with both the receptacle 27 and the bearing 29; pairs of springs 30; and collars 31 extending beyond the support plate 28 as well as the inner sheet metal cover 2, with bores which are aligned with the corresponding bores of the collars 21 of the housing 18, so that the collars 21 and 31 can be connected with each other with the aid of the shoe holding bolts 25. The support shoe 20 is immovably fixed in the housing 18, if required, by the shoe holding bolts 20. The support shoe 20 further has lateral walls 32, in which a shaft 33 is fastened, on which the bearing 29 rests, which is connected with the support plate 28, preferably by material to material contact. A support shoe 20 which is intended to be used in accordance with the invention can therefore be preassembled as a whole and fixed in place in the support shoe housing 18 with the aid of the two bolts 25. Once that is accomplished, the brace 17 can be inserted with its longitudinal end 19 into the receptacle 27 of the support shoe 20 and fixed in place by means of the so-called brace holding bolts 34. All bolts 25 and 34 are generally secured (for example with the aid of cotter pins).

Since all three bolts 25 and 34 are situated in the area outside of the plate 1, the bolts preferably are located in the same plane, assembly and disassembly of the support shoe 20 and the brace 17 can take place merely by inserting and securing or releasing the bolts 25 and 34.

In accordance with the invention, the support shoe housing 18 is directly welded to a profiled tube, or in a corner between two tube profiles for reasons of rigidity. A high torsion resistance of the support shoe housing 18 is already achieved by this. However, it must also be considered that in the course of forcing in or reversing a lining box constituted of two lining plates 1 in accordance with FIG. 2, considerable transverse forces of different strength and directions act on the support shoe housing 18. For this reason the support shoe formerly was not integrated into the inner, relatively soft elements of the lining plate, but into the profile frame. Because of the attainment of the object in accordance with the invention it is possible to leave the rigidity of the profile frame unhindered but still to fix the support shoe housing 18 or the support shoe 20 in place in the lining plate 1 with the required rigidity.

In order to also overcome the largest torsional moments actually occurring, which can act on the housing 18, it is furthermore advantageous to apply, preferably weld, extended brackets 35 and/or 36 to the longitudinal ends 22 and/or lateral walls 23 of the support shoe housing 18. The extended brackets 35, 36 can also be embodied as continuations of the lateral faces 22 or 23 on which they are seated. The extended brackets 35 are attached, for example, to the end faces (at the longitudinal ends 22 of the housing 18) which extend vertically or oblique in respect to the cover surface 3, 4. The extended brackets 36 are constituted, for example, as continuations of the longitudinal lateral walls 23 of the housing.

In actual use the extended brackets 35 and 36 can extend partially or completely over the adjoining hollow profiles 7 or 8. A support shoe housing 18 can basically also be provided in the corner between the hollow profiles 8 and 9. In any case, the lower edge of the extended brackets 35 and 36 should be welded to the adjoining sheet metal of the hollow profiles. By means of this even the strongest torsional moments exerted on the housing 18 can be absorbed, if required, without the deflection of the housing. If it is intended to use such a lining plate not only in box lining, but also in sliding rail lining, the lateral edge 11 of the plate is generally embodied as a rail, for example of a T-profile. In this case the extended brackets 35 should end at a distance from the T-rail profile.

In accordance with a further concept, the extended brackets 35 and 36 are provided with at least one bore 37. It is then possible to use the extended brackets 35 for connection plates 1 lying next to each other in the trench, using connecting elements, not shown. However, it is also possible to respectively draw a bolt 38 or the like through the bores 37 and in this way to provide an attachment point for a crane hook, a cable or like pulling means, with whose aid the lining plate can be pulled up and/or along the trench.

As stated, it is often sufficient for the torsion-resistant connection of the support shoe housing 18 to weld the housing 18 to the respectively adjoining hollow profiles 7, 8 of the frame 5. In accordance with FIG. 4, welding can be performed directly from the housing wall 23 to the adjoining or connecting inner hollow profile wall 39 by means of an essentially flat weld seam 40. However, it can also be advantageous or necessary to insert in accordance with FIG. 3 a (preferably massive) intermediate element 43 between the oblique housing wall 41 (at the longitudinal end 22 of the housing 18) and the nearest located inner hollow profile wall 42 and to weld it together with the adjoining walls 41 and 42—again essentially flat—.

The housing in a trench lining plate for receiving the support shoe for a brace, which is intended to be resiliently fastened, permits a simplified assembly of the support shoe directly assigned to the brace, if the housing has a housing collar with a housing bore extending vertically in respect to the longitudinal direction at the longitudinal ends at a distance from the brace, which projects out of the surface of the plate, and if the support shoe has a shoe collar corresponding to the housing collar, with a shoe bore aligned with the housing bore for the insertion of a shoe holding bolt.

If draw rings (not represented) are movably welded to the upper hollow profiles 7 in such a way that they project beyond the upper edge of the cross section when folded upward, and when during removal work using a crane four cables of even length are inserted into the draw rings of the one plate and over the bolts 38 of the housing 18 of the other plate of the lining box, the crane first pulls at the lower situated bolts 38 and at the draw rings only later, so that the one plate is first lifted. Because of the initial movement of the one plate in respect to the other, the mutual distance between the two plates is reduced as in a parallelogram. This has the result that the ground pressure against both outsides of the lining box is intended to be correspondingly reduced. If a lining box suspended from the described fastening means is lifted in the course of removal work, jarring of the ground previously generated by the jolt caused by pulling are avoided, and corresponding cracks in the road surface or the adjoining houses do not occur. The application of crane attachment means at different heights of the two plates by means of this embodiment of the invention makes it possible to pull the lining box during removal work from the trench at a reduced distance between the two lining plates. In this connection it is important that the cables are attached at different heights; it is also possible to use attachment means other than the ones mentioned.

| List of Reference Numerals | |
|---|---|
| 1 = | Lining plate |
| 2 = | Inner sheet metal cover |
| 3 = | Outer sheet metal cover |
| 4 = | Profiled sheet metal element |
| 5 = | Rectangular frame construction |
| 6 = | Frame corner |
| 7 = | Pressure cross beam |
| 8 = | Vertical cross beam |
| 9 = | Pointed hollow profile |
| 10 = | Upper plate edge |

-continued

| List of Reference Numerals | |
|---|---|
| 11 = | Lateral plate edge |
| 12 = | Cutting edge |
| 13 = | Lower plate edge |
| 14, 15 = | Cathetus |
| 16 = | Hypotenuse |
| 17 | Brace |
| 18 = | Support shoe housing |
| 19 = | Longitudinal end (17) |
| 20 = | Support shoe |
| 21 = | Collar (18) |
| 22 = | Longitudinal end (18) |
| 23 = | Lateral wall (18) |
| 24 = | Recess (21) |
| 25 = | Shoe holding bolt |
| 26 = | Drain hole |
| 27 = | Receptacle (19) |
| 28 = | Support plate |
| 29 = | Bearing |
| 30 = | Pair of springs |
| 31 = | Collar (20) |
| 32 = | Lateral wall (20) |
| 33 = | Shaft |
| 34 = | Brace holding bolt |
| 35, 36 = | Extended bracket |
| 37 = | Bore |
| 38 = | Bolt |
| 39 = | Inner hollow profile wall |
| 40 = | Weld seam (39) |
| 41 = | Housing wall (22) |
| 42 = | Inner hollow profile wall |
| 43 = | Intermediate element |

I claim:

1. A support shoe and housing assembly for use in a trench lining device of the type including a pair of trench lining plates on opposite sides of a trench, each plate having an exterior surface facing the interior of the trench and a support shoe in the plate for receiving and supporting a brace extending between the plates for maintaining the plates a predetermined distance apart, and including a brace holding bolt for fastening the brace to the support shoe, said support shoe and housing assembly comprising:

a support shoe housing positioned in the lining plate and having longitudinal ends, said housing including a brace bore aligned transversely with respect to the longitudinal direction of the housing for receiving the brace holding bolt;

a pair of housing collars on the longitudinal ends of the housing, said housing collars projecting a radial distance on both sides of the brace holding bolt beyond adjoining exterior surface of the lining plate;

at least one continuous housing bore within the housing collars;

a support shoe within said housing, said support shoe including means for resiliently fastening the brace in the lining plate;

a pair of shoe collars corresponding to the housing collars and being positioned therein to extend substantially parallel with the housing collars; and at least one continuous shoe bore in alignment with said housing bore for receiving a shoe holding bolt therethrough.

2. The shoe support and housing assembly of claim 1, wherein said shoe bore and said brace bore are positioned with respect to each other whereby the brace holding bolt and shoe holding bolt inserted therein lie parallel to each other with respect to the exterior surface of the lining plate.

3. The shoe support and housing assembly of claim 1, wherein said shoe support housing includes a housing bottom and housing walls extending from the housing bottom to the longitudinal ends of the housing, said housing walls being positioned to lie obliquely to the adjoining exterior surface of the lining plate whereby said housing is conically opened toward the exterior surface of the lining plate.

4. The shoe support and housing assembly of claim 3, wherein said housing includes a drain hole in the housing bottom.

5. A trench lining assembly for supporting a brace within the interior of a trench, said assembly comprising:

a pair of trench lining plates, each plate having an exterior surface facing the interior of the trench and including a hollow profile frame having hollow profile elements;

a support shoe housing being positioned in each lining plate, said housing including longitudinal ends and a brace bore aligned transversely with respect to the longitudinal direction of the housing for receiving a brace holding bolt;

a pair of housing collars on the longitudinal ends of the housing, said housing collars projecting beyond the exterior surface of the lining plate;

at least one continuous housing bore within the housing collars;

a support shoe adapted to be resiliently fastened within said housing for receiving and supporting the brace extending between the plates for maintaining the plates a predetermined distance apart;

a pair of shoe collars corresponding to the housing collars and being positioned therein to extend substantially parallel with the housing collars; and at least one continuous shoe bore in alignment with said housing bore for receiving a shoe holding bolt therethrough.

6. The trench lining assembly of claim 5, wherein said housing is welded to the lining plate.

7. The trench lining assembly of claim 5, wherein said housing further includes an extended bracket on at least one of said housing collars and extending essentially parallel therewith, said extended bracket projecting beyond the exterior surface of the lining plate.

8. The trench lining assembly of claim 7, wherein said extended bracket extends partially or completely over the adjoining hollow profile element transversely to its longitudinal extent.

9. The trench lining assembly of claim 7, wherein said housing collars include walls and said extended bracket forms an extension of one wall of one of said housing collars.

10. The trench lining assembly of claim 7, wherein said extended bracket defines a connecting means, said bracket including at least one bore.

11. The trench lining assembly of claim 10, wherein said connecting means includes a bolt inserted between two adjoining extended brackets for attaching a pulling means.

12. The shoe support and housing assembly of claim 1, wherein said shoe support housing includes a housing bottom and housing walls extending from the housing bottom to the longitudinal end of the housing, said housing walls being positioned to lie obliquely to the adjoining exterior surface of the lining plate whereby said housing is conically opened toward the exterior surface of the lining plate.

13. The trench lining assembly of claim 6, wherein said assembly further includes an intermediate element adjacent to the lining plate and said housing is connected to the lining plate via the intermediate element.

14. The trench lining assembly of claim 6, wherein said housing further includes an extended bracket on at least one of said housing collars and extending essentially parallel therewith, said extended bracket projecting beyond the exterior surface of the lining plate.

15. The trench lining assembly of claim 7, wherein said extended bracket extends over the adjoining hollow profile element and is welded to said adjoining hollow profile element.

16. The trench lining assembly of claim 8, wherein said housing collars include walls and said extended bracket forms an extension of a wall of one of said housing collars.

17. The trench lining assembly of claim 10, wherein said extended bracket includes an adjacent or a raised plate including said bore.

18. The shoe support and housing assembly of claim 2, wherein said housing further includes an extended bracket on at least one of said housing collars and extending essentially parallel therewith, said extended bracket projecting beyond the exterior surface of the lining plate.

19. The shoe support and housing assembly of claim 18, wherein said housing collars include walls and said extended bracket forms an extension of one wall of one of said housing collars.

20. The shoe support and housing assembly of claim 18, wherein said extended bracket defines a connecting means, said bracket including at least one bore.

21. The shoe support and housing assembly of claim 20, wherein said extended bracket further includes a bolt inserted between two adjoining extended brackets for attaching a pulling means.

22. A shoe support and housing assembly for use in a trench lining plate for supporting one end of a brace which projects outward from the surface of the plate, said assembly comprising:

a shoe support housing in the trench lining plate, said housing including longitudinal ends having a housing collar projecting outward at both ends;

a housing bore in said housing collar extending vertically with respect to the longitudinal direction at the longitudinal ends of the housing and being positioned a predetermined distance from the brace;

a support shoe in the housing, said support shoe having a shoe collar corresponding to the housing collar and a receptacle for receiving the end of the brace; and a shoe bore in said support shoe in alignment with said housing bore for the insertion of a shoe holding bolt for fastening said housing collar and said shoe collar together for securing said shoe support to said shoe support housing.

23. The shoe support and housing assembly of claim 22, wherein said support shoe further includes a means for resiliently fastening the end of the brace therein, said means comprising:

a support plate connected to and supporting the receptacle;

a bearing connected to and supporting the support plate;

a pair of springs adjacent to the bearing for supporting the support plate; and wherein the receptacle is seated resiliently inside the support shoe.

* * * * *